US008237581B2

(12) United States Patent
Ries, II

(10) Patent No.: US 8,237,581 B2
(45) **Date of Patent: *Aug. 7, 2012**

(54) EXTENDED LIFE LED FIXTURE WITH CENTRAL CONTROLLER AND MULTI-CHIP LEDS

(75) Inventor: Jack Leighton Ries, II, Granville, OH (US)

(73) Assignee: ABL IP Holding LLC, Conyers, GA (US)

( * ) Notice: Subject to any disclaimer, the term of this patent is extended or adjusted under 35 U.S.C. 154(b) by 853 days.

This patent is subject to a terminal disclaimer.

(21) Appl. No.: 12/359,069

(22) Filed: Jan. 23, 2009

(65) Prior Publication Data

US 2009/0128060 A1 May 21, 2009

Related U.S. Application Data

(62) Division of application No. 11/869,562, filed on Oct. 9, 2007, now Pat. No. 7,839,295.

(51) Int. Cl.
*G08B 5/22* (2006.01)
*G08B 23/00* (2006.01)

(52) U.S. Cl. ..... 340/815.45; 340/321; 340/691.1; 340/332; 362/800

(58) Field of Classification Search ..... 340/815.45
See application file for complete search history.

(56) References Cited

U.S. PATENT DOCUMENTS

| | | | | |
|---|---|---|---|---|
| 4,945,280 | A | 7/1990 | Beghelli | |
| 5,633,564 | A | 5/1997 | Edwards et al. | |
| 5,684,368 | A | 11/1997 | Wei et al. | |
| 5,812,105 | A | 9/1998 | Van de Ven | |
| 6,236,331 | B1 | 5/2001 | Dussureault | |
| 6,614,358 | B1 | 9/2003 | Hutchison et al. | |
| 6,788,298 | B2 | 9/2004 | Kota et al. | |
| 6,796,690 | B2 | 9/2004 | Bohlander | |
| 6,933,680 | B2 | 8/2005 | Oskorep et al. | |
| 7,009,603 | B2 | 3/2006 | Page et al. | |
| 7,088,321 | B1 | 8/2006 | Parker | |
| 7,102,172 | B2 | 9/2006 | Lynch et al. | |
| 7,138,970 | B2 | 11/2006 | Krohn | |
| 7,839,295 | B2 * | 11/2010 | Ries, II | 340/815.45 |
| 2002/0043943 | A1 | 4/2002 | Menzer et al. | |
| 2002/0149929 | A1 | 10/2002 | Evans et al. | |

(Continued)

FOREIGN PATENT DOCUMENTS

WO WO-2009048926 4/2009

OTHER PUBLICATIONS

Non-Final Office Action for U.S. Appl. No. 11/869,562 mailed Jan. 22, 2010, ten pages.

(Continued)

*Primary Examiner* — Donnie Crosland
(74) *Attorney, Agent, or Firm* — Kilpatrick Townsend & Stockton LLP

(57) ABSTRACT

An LED fixture includes multiple LED drivers and a multi-chip LED package so that the lifetime of the fixture is a multiple of the lifetime of a conventional fixture that uses only a single LED driver. A central controller activates and deactivates the LED drivers so that different subsets of LEDs within the LED package are driven sequentially. An optional multi-chip LED driver concurrently drives multiple subsets of LEDs that were previously driven by the LED drivers.

22 Claims, 10 Drawing Sheets

U.S. PATENT DOCUMENTS

| | | | |
|---|---|---|---|
| 2002/0167475 | A1 | 11/2002 | Dennehey |
| 2002/0175826 | A1 | 11/2002 | Hutchison et al. |
| 2003/0174499 | A1 | 9/2003 | Bohlander |
| 2004/0108982 | A1 | 6/2004 | Krohn |
| 2005/0206529 | A1 | 9/2005 | St.-Germain |
| 2005/0218838 | A1 | 10/2005 | Lys |
| 2006/0022214 | A1 | 2/2006 | Morgan et al. |
| 2006/0039168 | A1 | 2/2006 | Mier-Langner et al. |
| 2007/0040696 | A1 | 2/2007 | Mubaslat et al. |
| 2007/0041220 | A1 | 2/2007 | Lynch |
| 2009/0091467 | A1 | 4/2009 | Ries |
| 2009/0128052 | A1 | 5/2009 | Ries |
| 2009/0128054 | A1 | 5/2009 | Ries |

OTHER PUBLICATIONS

Final Office Action for U.S. Appl. No. 11/869,562 mailed Jul. 16, 2010, six pages.

Office Action in Canadian Patent Application No. 2,640,829 mailed on Jun. 14, 2011, three pages.

* cited by examiner

EXTENDED LIFE LED FIXTURE WITH CENTRAL CONTROLLER AND MULTI-CHIP LEDS

RELATED APPLICATIONS

This application is a divisional patent application of U.S. application Ser. No. 11/869,562 entitled "Extended Life LED Fixture", filed on Oct. 9, 2007 now U.S. Pat. No. 7,839,295. This application is also related to U.S. application Ser. No. 12/359,054 entitled "Extended Life LED Fixture with Central Controller and LED Lamps", filed on Jan. 23, 2009, and U.S. application Ser. No. 12/359,090 entitled "Extended Life LED Fixture with Distributed Controller with Multi-Chip LEDs", filed on Jan. 23, 2009, both of which are concurrently filed herewith. All of the aforementioned applications are incorporated herein in their entirety by reference.

FIELD OF THE INVENTION

The invention relates generally to light emitting diode (LED) based lighting fixtures, and more particularly to fixtures using multiple LED drivers and multiple LED lamps or multi-chip LED packages to provide an extended life fixture.

BACKGROUND

LEDs have become a popular choice for light fixtures due to their relatively inexpensive cost, low voltage requirements, compact size, and longer operating lifetime. The operating lifetime of an LED fixture is limited in part due to the decrease in output light intensity of the LEDs over time. This decrease or lumen depreciation is affected by temperature so even though the brightness of the LEDs can be increased by increasing the electrical current supplied to the LEDs, the increased current increases the temperature of the LEDs, which in turn reduces the efficiency and lifetime of the LEDs.

Conventional LED light fixtures consist of a single driver and a single LED board or lamp, so once the driver fails or the light intensity decreases substantially, the light fixture must be replaced. For some applications, such as highway signage, street lighting on busy highways, and lighting in hazardous areas, replacement is difficult due to the position or location of the fixture. For other applications replacement is difficult due to the disruption associated with the replacement, such as having to stop or pause a production or manufacturing line or having to limit access to an area.

SUMMARY OF THE INVENTION

It is therefore an object of the present invention to extend the lifetime of LED light fixtures and reduce LED replacement activity costs. The present invention uses multiple drivers and multiple LED lamps or multi-chip LED packages so that the lifetime of the fixture is multiples of the lifetime of a conventional fixture. For example, rather than a light fixture with 10 LEDs and one LED driver, the present invention provides a light fixture with 20 LEDs and two LED drivers or a light fixture with 30 LEDs and three drivers, where each driver drives ten LEDs. When the first LED driver or LED lamp has been operating for a predetermined time or its operating parameters are out of range, the first LED driver and lamp are deactivated and the second LED driver and lamp are activated. This process continues until all of the drivers have been activated. In this manner the expected lifetime of the light fixture is increased two or three times. For example, if a fixture with a single LED driver uses LEDs with a rated lifetime of 50,000 hours, then the lifetime can be increased from 50,000 hours to 100,000 hours by using two LED drivers and two LED lamps (or an appropriate number of multi-chip LED packages) or to 150,000 hours by using three LED drivers and three LED lamp (or an appropriate number of multi-chip LED packages).

According to one aspect of the invention, a single light fixture or luminaire includes multiple LED lamps or LED boards, multiple LED drivers, and a central controller, where each LED lamp is connected to a distinct LED driver and the central controller is connected to each of the LED drivers. The central controller activates the first LED driver to drive the first LED lamp. The central controller then monitors the first LED driver until an operating parameter satisfies a predetermined value. The predetermined value is based on operating factors, such as expected or actual lifetime of the LED driver or LED lamp or expected or actual degradation in performance of the LED driver or LED lamp. Once the monitored operating parameter of the first LED driver satisfies the predetermined value, the central controller deactivates the first LED driver which deactivates the first LED lamp and activates the second LED driver which drives the second LED lamp. The controller monitors and controls the second and any remaining LED drivers in a manner similar to the first LED driver and lamp.

Although some LEDs could be expected to operate well beyond their claimed rating (e.g. 50,000 hours), it is generally acknowledged that their lamp lumen depreciation is too high for operation beyond this rating point. In one aspect of the invention a multi-lamp LED driver concurrently drives multiple depreciated LED lamps to provide a light level that approximates the initial light level. Once all of the LED drivers have been activated, the controller activates the multi-lamp LED driver which drives two or more of the LED lamps that were previously driven by the LED drivers. The multi-lamp LED driver may drive the LED lamps at the same level as the LED drivers or at a different level depending upon the lumen depreciation characteristics of the LED lamps.

According to another aspect of the invention, the controller function is distributed between the LED drivers. The single light fixture includes multiple LED lamps and multiple LED drivers and each LED driver includes a controller. The controller can be integrated with the LED driver or can be provided by a separate device that is connected to the LED driver.

The controller of the first LED driver activates the first LED driver to drive the first LED lamp. The controller of the first LED driver monitors an operating parameter of the first LED driver until the operating parameter satisfies a predetermined value. Once the monitored operating parameter of the first LED driver satisfies the predetermined value, the controller of the first LED driver deactivates the first LED driver which deactivates the first LED lamp and activates the second LED driver so that it drives the second LED lamp. The controller of the second and any remaining LED drivers operates in a similar manner to the controller of the first LED driver.

In another aspect of the invention a multi-lamp LED driver concurrently drives multiple depreciated LED lamps to provide a light level that approximates the initial light level. Once all of the LED drivers have been activated, the controller associated with the last LED driver to be activated, activates the multi-lamp LED driver which drives two or more of the LED lamps that were previously driven by the LED drivers. The multi-lamp LED driver may drive the LED lamps at the same level as the LED drivers or at a different level depending upon the lumen depreciation characteristics of the LED lamps.

The present invention can operate with multi-chip LED packages instead of LED lamps. Different LED drivers drive different subsets of LEDs within a package. For example, if there are four chips within a package, then a first LED driver drives two of the chips and a second LED driver drives the remaining two chips.

According to one aspect of the invention, a single light fixture includes multiple LED drivers, at least one multi-chip LED package, and a central controller, where each LED driver is connected to a distinct subset of LEDs and the central controller is connected to each of the LED drivers. The central controller activates the first LED driver to drive the first subset of LEDs. The central controller then monitors the first LED driver until an operating parameter satisfies a predetermined value. The predetermined value is based on operating factors, such as expected or actual lifetime of the LED driver or LEDs or expected or actual degradation in performance of the LED driver or LEDs. Once the monitored operating parameter of the first LED driver satisfies the predetermined value, the central controller deactivates the first LED driver which deactivates the first subset of LEDs and activates the second LED driver which drives the second subset of LEDs. The controller monitors and controls the second and any remaining LED drivers in a manner similar to the first LED driver and first subset of LEDs.

In another aspect of the invention a multi-chip LED driver concurrently drives multiple depreciated subsets of LEDs to provide a light level that approximates the initial light level. Once all of the LED drivers have been activated, the controller activates the multi-chip LED driver which drives two or more of the subsets of LEDs that were previously driven by the LED drivers. The multi-chip LED driver may drive the subsets of LEDs at the same level as the LED drivers or at a different level depending upon the lumen depreciation characteristics of the LEDs.

According to another aspect of the invention, the controller function is distributed between the LED drivers. The single light fixture includes at least one multi-chip LED package and multiple LED drivers, where each LED driver includes a controller and each of the LED drivers drives a distinct subset of LEDs. The controller can be integrated with the LED driver or can be provided by a separate device that is connected to the LED driver.

The controller of the first LED driver activates the first LED driver to drive the first subset of LEDs. The controller of the first LED driver monitors an operating parameter of the first LED driver until the operating parameter satisfies a predetermined value. Once the monitored operating parameter of the first LED driver satisfies the predetermined value, the controller of the first LED driver deactivates the first LED driver which deactivates the first subset of LEDs and activates the second LED driver so that it drives the second subset of LEDs. The controller of the second and any remaining LED drivers operates in a similar manner to the controller of the first LED driver.

In another aspect of the invention a multi-chip LED driver concurrently drives multiple depreciated subsets of LEDs to provide a light level that approximates the initial light level. Once all of the LED drivers have been activated, the controller associated with the last LED driver to be activated, activates the multi-chip LED driver which drives two or more subsets of LEDs that were previously driven by the LED drivers. The multi-chip LED driver may drive the subsets of LEDs at the same level as the LED drivers or at a different level depending upon the lumen depreciation characteristics of the LEDs.

Other features, advantages, and objects of the present invention will be apparent to those skilled in the art with reference to the remaining text and drawings of this application.

DETAILED DESCRIPTION

The present invention provides an extended life LED fixtures. Briefly described, a single fixture includes multiple drivers and multiple LED lamps or multi-chip LED packages so that a single light fixture provides multiples of a conventional fixture's lifetime. A controller, which can either be centralized or distributed, activates and deactivates the LED drivers so that the different LED lamps or subsets of LEDs are driven sequentially. Some embodiments include a multi-lamp LED driver or a multi-chip LED driver to concurrently drive multiple LED lamps or multiple subsets of LEDs that have previously been driven by the LED drivers.

Multiple LED Lamps and Multiple LED Drivers

FIGS. 1-4 illustrate light fixtures that use LED lamps or LED boards. Each LED lamp includes a number of LEDs that are driven as a single unit.

Centralized Control

Figure 1:
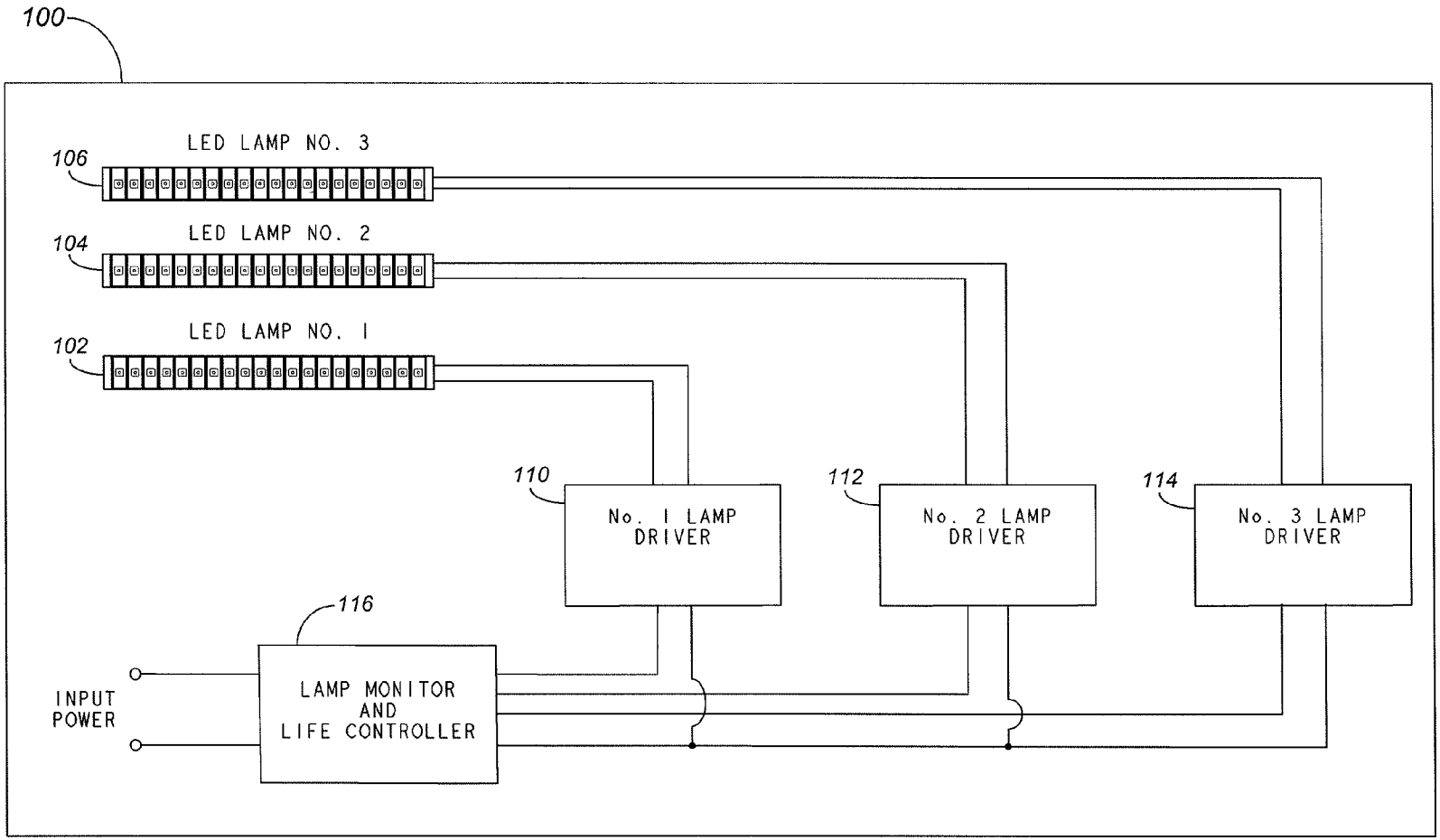
FIG. 1 illustrates a single light fixture with multiple LED drivers, multiple LED lamps, and a central controller according to one embodiment of the invention.

FIG. 1 illustrates one embodiment of the present invention where a single light fixture or luminaire 100 includes three LED lamps 102, 104 and 106, three LED drivers, 110, 112 and 114, and a central controller 116. Each LED lamp 102, 104 and 106 is connected to a distinct LED driver 110, 112 and 114, respectively, and the central controller 116 is connected to each of the LED drivers. Each LED lamp (e.g. 102) illustrated by FIG. 1 includes 20 LEDs. Although the number of LEDs in each LED lamp may vary, each LED lamp typically includes the same number of LEDs. An LED driver (such as LED drivers 110, 112 and 114) provides the function of a conventional LED driver that activates/powers (i.e., turn on/off) the associated LED lamp.

The central controller 116 activates the first LED driver 110 to drive the first LED lamp 102. The central controller 116 then monitors the first LED driver 110 until one or more operating parameters satisfy certain predetermined values. The predetermined values are based on one or more operating factors, such as expected or actual lifetime of the LED driver or LED lamp or expected or actual degradation in performance of the LED driver or LED lamp. Once the monitored operating parameter of the first LED driver 110 satisfies the predetermined value, the central controller 116 deactivates the first LED driver 110 which deactivates the first LED lamp 102.

If the operating parameter is based on time, such as an expected or rated lifetime or expected or rated lumen depreciation, then the central controller includes a timer function to keep track of the time that the LED drivers and lamps are activated. If the operating parameter is based on an actual output of the LED drivers or LED lamps, then the central controller includes an input from the LED drivers or lamps that corresponds to the monitored parameter or an input from a sensor that senses the monitored parameter. In some embodiments, the operating parameter corresponds to the current, voltage or power drawn by the LED lamp. In other embodiments, the operating parameter corresponds to the amount of light being output.

Once the first LED driver is deactivated, the central controller 116 activates and monitors the second LED driver 112 which drives the second LED lamp 104. Once the second LED driver satisfies the predetermined value, the central controller 116 deactivates the second LED driver 112 which deactivates the second LED lamp 104. The central controller 116 then activates the third LED driver 114 that drives the third LED lamp 106. In one embodiment, the central controller monitors the third LED driver 114 and once the predetermined value is met the central controller 116 deactivates the third LED driver 114 which deactivates the third LED lamp 106. In another embodiment, the central controller does not monitor the third LED driver and allows it to operate until it fails or is replaced. By using multiple LED drivers and multiple LED lamps the time between replacements is significantly longer than with a conventional fixture with a single LED lamp and driver. In the embodiment illustrated by FIG. 1, the time between replacements is approximately three times longer than with a conventional fixture that uses a single LED lamp and driver.

FIG. 1 illustrates that the central controller is connected to the power input to the fixture. In this embodiment, the central controller gates the power to the LED drivers to activate and deactivate the LED drivers. As will be apparent to those skilled in the art, other methods of activating and deactivating the LED drivers can be used, including, but not limited to having the central controller generate an enable signal to each of the LED drivers. Although FIG. 1 illustrates that the central controller is physically connected to the LED drivers, other embodiments may use wireless communication between the central controller and the LED drivers.

Centralized Control with Multi-Lamp LED Driver

Figure 2:
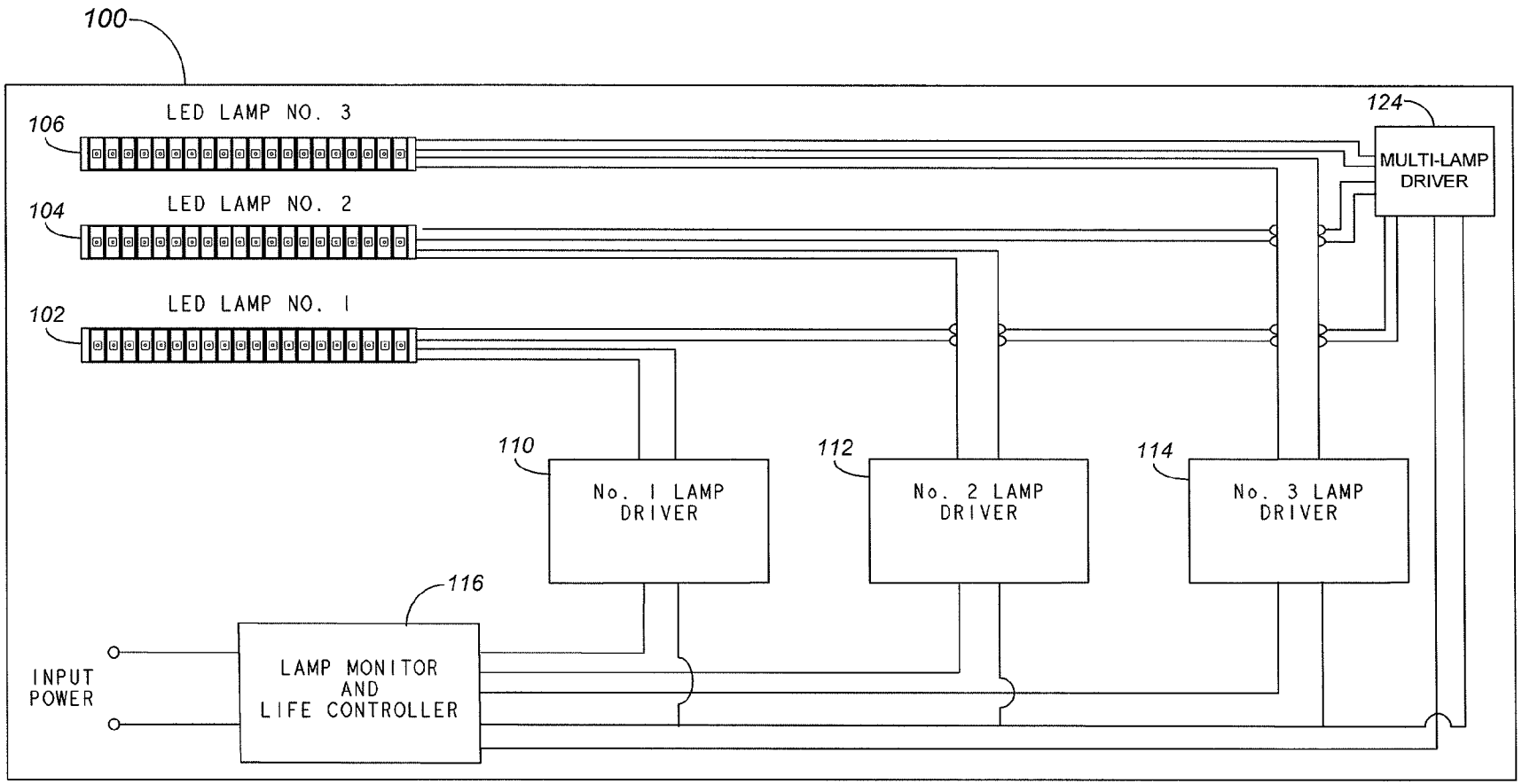
FIG. 2 illustrates a single light fixture with multiple LED drivers, a multi-lamp LED driver, multiple LED lamps, and a central controller according to one embodiment of the invention.

FIG. 2 illustrates another embodiment of a multiple driver, multiple lamp fixture that differs from the embodiment illustrated by FIG. 1 by the addition of a multi-lamp LED driver. The single light fixture 100 includes three LED lamps 102, 104 and 106, three LED drivers 110, 112 and 114, a multi-lamp LED driver 124, and a central controller 116. The components of the light fixture are connected in a manner similar to that described above in connection with FIG. 1. The multi-lamp LED driver 124 is connected to the central controller 116 and LED lamps 102, 104 and 106.

The operation of the light fixture illustrated by FIG. 2 is essentially the same as FIG. 1 for the activation and deactivation of the first LED driver and lamp, the second LED driver and lamp, and the third LED driver and lamp. Once the operating parameter of the third LED driver 114 satisfies the predetermined value, the central controller 116 deactivates the third LED driver which deactivates the third LED lamp and activates the multi-lamp LED driver which concurrently activates the first, second and third LED lamps. In some embodiments, the central controller monitors the operating parameters of the multi-lamp LED driver and deactivates the multi-lamp LED driver when the operating parameter satisfies a predetermined value. In other embodiments, the central controller does not monitor the multi-lamp LED driver.

As discussed above, the operating parameter can correspond to time, such as the expected lifetime of the LED driver, expected lifetime of the LED lamps, and/or an expected lumen depreciation of the LED lamps. If the predetermined value of the operating parameter is selected based on an expected lifetime of the LED driver and the LED lamps have a longer lifetime, then the embodiment illustrated by FIG. 2 can be used to drive the LED lamps past the life of their corresponding LED drivers. Driving multiple LED lamps that have experienced some lumen deficiency concurrently with the multi-lamp LED driver produces light at a level approximating the initial level. For example, if the expected or rated lifetime of an LED driver is 50,000 hours and the lumen depreciation of the LED lamps is 70% after 50,000 hours, then driving three LED lamps having 30% of their initial light levels concurrently produces 90% of the initial light level.

The multi-lamp LED driver can drive the LED lamps at the same level (e.g., same current) as the LED drivers or at a different level. For example, if the expected or rated lifetime of an LED driver is 50,000 hours and the lumen depreciation of the LED lamps is 50% after 50,000 hours, then driving three LED lamps having 50% of their initial light levels concurrently at 70% of the initial current level produces approximately 100% of the initial light level.

FIG. 2 illustrates that the multi-lamp LED driver drives all of the LED lamps within the light fixture concurrently. Depending upon the expected lifetime of the LED drivers and the expected lumen depreciation of the LED lamps, in other embodiments the multi-lamp LED driver drives less than all of the LED lamps. For example, if the expected or rated lifetime of an LED driver is 50,000 hours and the lumen depreciation of the LED lamps is 50% after 50,000 hours, then driving two LED lamps having 50% of their initial light levels concurrently produces 100% of the initial light level with only two of the three LED lamps. Alternatively, the light fixture can include a fourth LED lamp and associated driver and a second multi-lamp LED driver can drive the remaining two LED lamps.

FIG. 2 illustrates that the central controller is connected to the power input into the fixture. In this embodiment, the central controller gates the power to the LED drivers and the multi-lamp LED driver to activate and deactivate the LED drivers and the multi-lamp LED driver. As described in connection with FIG. 1 above, other methods of activating and deactivating the LED drivers and multi-lamp LED driver can be used.

Distributed Control

Figure 3:
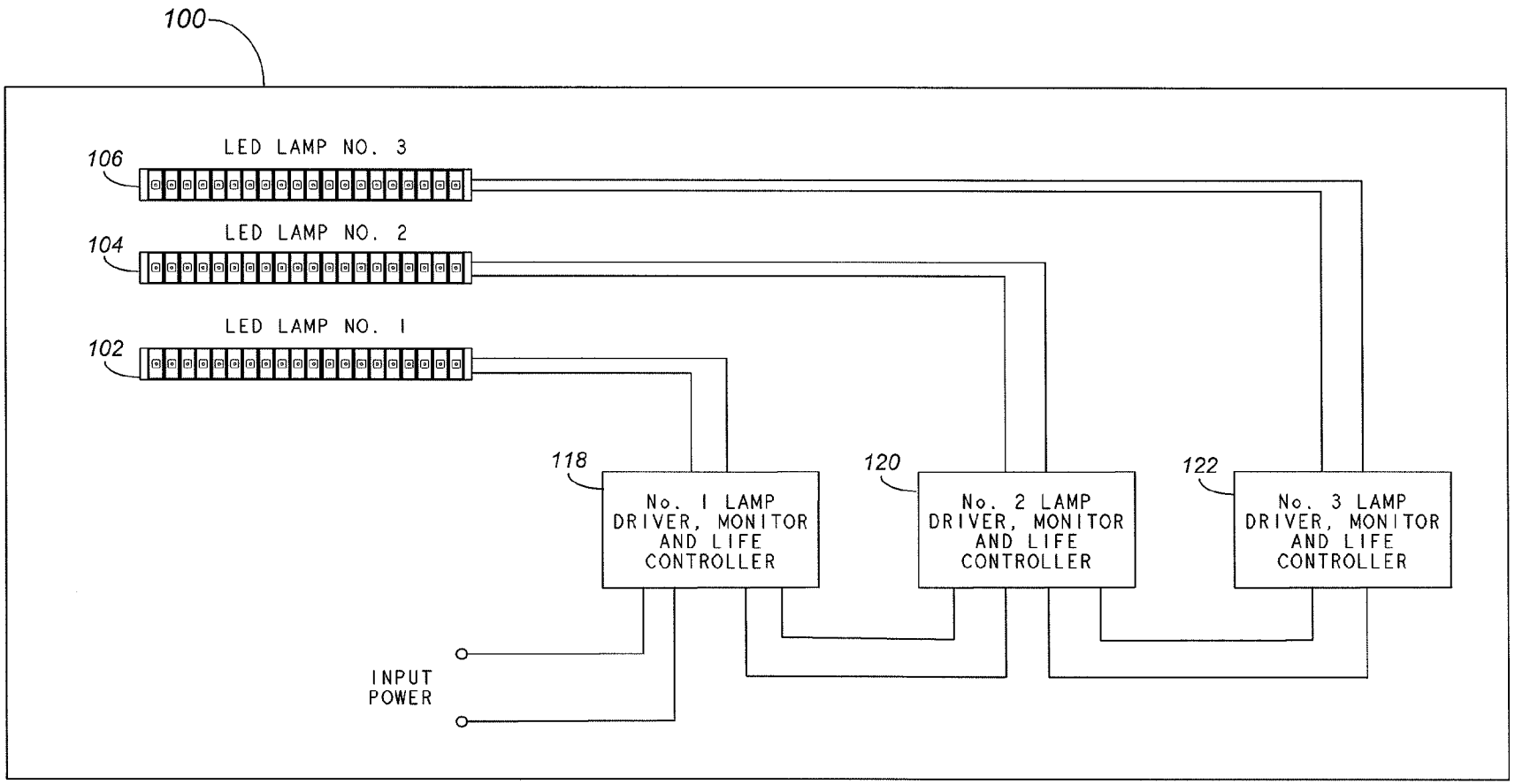
FIG. 3 illustrates a single light fixture with multiple LED drivers and controllers and multiple LED lamps according to one embodiment of the invention.

FIG. 3 illustrates another embodiment of the present invention that differs from the embodiment illustrated by FIG. 1 in that the controller function is distributed among the LED drivers. The single light fixture 100 includes three LED lamps 102, 104 and 106, and three LED drivers 118, 120 and 122. Each LED driver 118, 120 and 122 includes a controller and is connected to at least one other LED driver (i.e., 118 is connected to 120, 120 is connected to 118 and 122, and 122 is connected to 120). The controller function can be integrated with the LED driver or can be provided by a separate device that is connected to the LED driver.

The controller of the first LED driver activates the first LED driver 118 to drive the first LED lamp 102. The controller of the first LED driver 118 monitors one or more operating parameters of the first LED driver 118 until the operating parameters satisfy predetermined values. Once the monitored operating parameter of the first LED driver 118 satisfies the predetermined value, the controller of the first LED driver 118 deactivates the first LED driver 118 which deactivates the first LED lamp 102 and activates the second LED driver 120 so that it drives the second LED lamp 104.

The controller of the second LED driver 120 monitors one or more operating parameters of the second LED driver 120. Once the operating parameter satisfies a predetermined value, the controller deactivates the second LED driver 120 which deactivates the second LED lamp 104 and activates the third LED driver 122. In some embodiments, the controller of the third LED driver 122 monitors the third LED driver 122. Once the operating parameter satisfies the predetermined criteria, the controller of the third LED driver 122, deactivates the third LED driver 122 which deactivates the third LED lamp 106. In other embodiments, the third LED driver does not include a controller and the third LED driver and lamp are operated until they fail or are replaced.

FIG. 3 illustrates that the power input to the fixture is fed into the first LED controller. In this embodiment, the first LED controller gates the power to the first LED driver to activate and deactivate the first LED driver and gates the power to the second LED controller. The second LED controller gates the power to the second LED driver to activate and deactivate the second LED driver and gates the power to the third LED controller. The third LED controller gates the power to the third LED driver to activate and deactivate the third LED driver. As will be apparent to those skilled in the art, other methods of activating and deactivating the LED drivers can be used, including methods using wireless communication between the LED controllers.

Distributed Control with Multi-Lamp LED Driver

Figure 4:
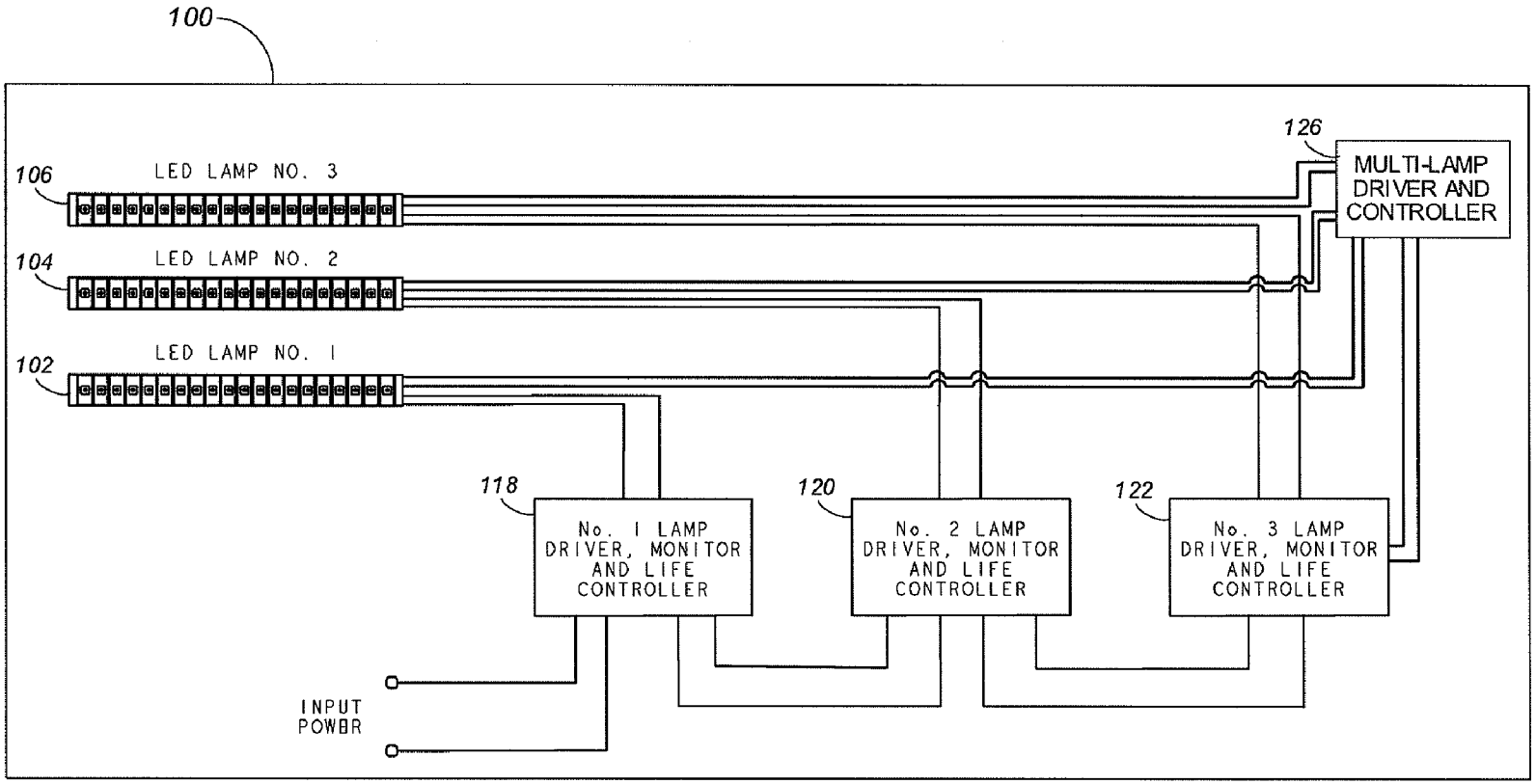
FIG. 4 illustrates a single light fixture with multiple LED drivers and controllers, a multi-lamp LED driver and controller, and multiple LED lamps according to one embodiment of the invention.

FIG. 4 illustrates another embodiment of the present invention that differs from the embodiment illustrated by FIG. 3 by the addition of a multi-lamp LED driver and controller. The single light fixture 100 includes three LED lamps 102, 104 and 106, three LED drivers 118, 120 and 122. Each LED driver 118, 120 and 122 includes a controller and is connected to at least one other LED driver (i.e., 118 is connected to 120, 120 is connected to 118 and 122, and 122 is connected to 120). The third LED driver also is connected to a multi-lamp LED driver and controller 126 which is connected to the first, second and third LED lamps.

The operation of the light fixture illustrated by FIG. 4 is essentially the same as FIG. 3 for the activation and deactivation of the first LED driver and lamp, the second LED driver and lamp, and the third LED driver and lamp. Once the operating parameter of the third LED driver 114 satisfies the predetermined value, the third LED controller deactivates the third LED lamp and activates the multi-lamp LED driver which activates the first, second and third LED lamps.

Although FIG. 4 illustrates that the multi-lamp LED driver drives all of the LED lamps in the fixture, in other embodiments, as discussed above in connection with FIG. 2, the multi-lamp LED driver may drive less than all of the LED lamps.

FIG. 4 illustrates that the power input to the fixture is fed into the first LED controller. In this embodiment, the first LED controller gates the power to the first LED driver to activate and deactivate the first LED driver and gates the power to the second LED controller. The second LED controller gates the power to the second LED driver to activate and deactivate the second LED driver and gates the power to the third LED controller. The third LED controller gates the power to the third LED driver to activate and deactivate the third LED driver and gates the power to the multi-lamp LED driver. The multi-lamp LED controller gates the power to the multi-lamp LED driver. As will be apparent to those skilled in the art, other methods of activating and deactivating the LED drivers can be used, including wireless communication between the LED controllers.

Multiple Multi-Chip LED Packages and Multiple LED Drivers

FIGS. 1-4 illustrate light fixtures that use LED lamps. Alternatively, multi-chip LED packages can be used. A multi-chip LED package has at least two LED chips within the same package. The LED chips can be driven independently (i.e., each chip is connected to a different driver) or in subsets (e.g. two or more chips are connected to the same driver). In some embodiments the LED lamps illustrated by FIGS. 1-4 are simply replaced by the appropriate number of multi-chip LED packages. In other embodiments, different drivers are used to drive different chips within the multi-chip LED package. The use of multi-chip LED packages rather than single chip LED lamps permit a more compact design due to the smaller luminaire optical package and may provide a more cost effective solution due to the lower packaging cost of the chips.

Centralized Control

Figure 5:
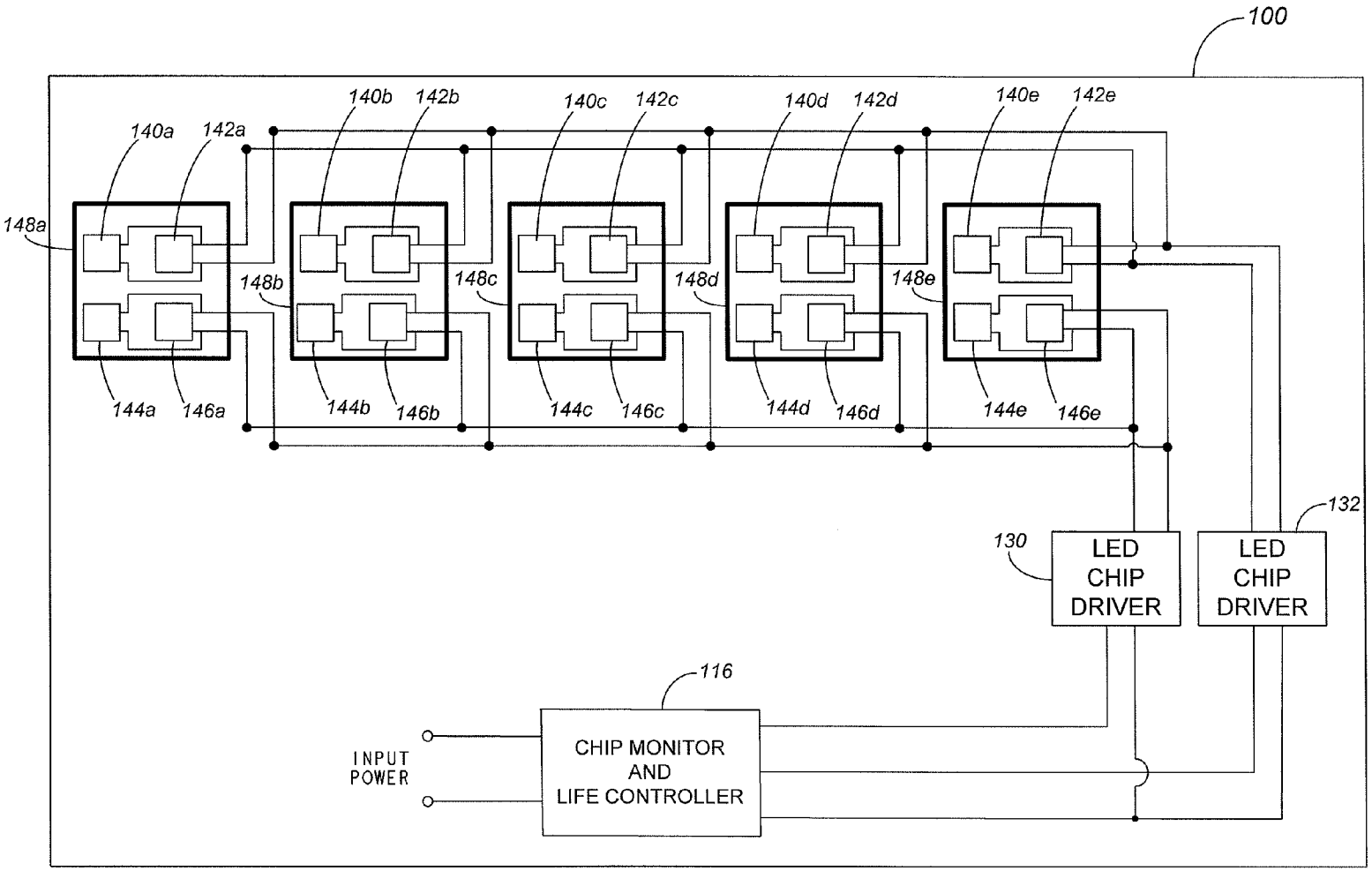
FIG. 5 illustrates a single light fixture with multiple LED drivers, multiple multi-chip LED packages, and a central controller LED chips according to one embodiment of the invention.

FIG. 5 illustrates an embodiment using multi-chip LED packages where different drivers drive different chips within the package. The single light fixture 100 includes a first LED driver 130, a second LED driver 132, a central controller 116, and five multi-chip LED packages 148*a*, 148*b*, 148*c*, 148*d*, 148*e* with each multi-chip package containing four LED chips e.g., 140*a*, 142*a*, 144*a*, 146*a*. The central controller is connected to the first LED driver and the second LED driver. The first LED driver is connected to two of the four LED chips, e.g., 144*a*, 146*a*, within each of the multi-chip LED packages and the second LED driver is connected to the remaining two LED chips e.g., 140*a*, 142*a*, within the multi-chip LED packages.

The operation of the light fixture illustrated by FIG. 5 is similar to that described above in connection with FIG. 1 except that instead of the first LED driver and the second LED driver driving separate LED lamps, the drivers drive different chips within the multi-chip LED packages. The central controller 116 activates the first LED driver 130 to drive a first subset of LED chips in each multi-chip LED package 144*a*, 146*a*, 144*b*, 146*b*, 144*c*, 146*c*, 144*d*, 146*d*, 144*e*, 146*e*. The central controller 116 monitors the first LED driver until one or more operating parameters satisfy certain predetermined criteria or values. The predetermined values are based on the same type of factors described above in connection with the embodiments that use LED lamps. Once the monitored operating parameter of the first LED driver 130 satisfies the predetermined value, the central controller 116 deactivates the first LED driver 130 which deactivates the first subset of LED chips. The central controller then activates the second LED driver 132 to drive the second subset of LED chips in each multi-chip LED package 140*a*, 142*a*, 140*b*, 142*b*, 140*c*, 142*c*, 140*d*, 142*d*, 140*e*, 142*e*. In some embodiments, the central controller monitors the second LED driver and once the predetermined value is met the central controller deactivates the second LED driver 132 which deactivates the second subset of LED chips. In other embodiments, the central controller does not monitor the second LED driver and allows it to operate until it fails or is replaced.

FIG. 5 illustrates that the central controller is connected to the power input into the fixture. In this embodiment, the central controller gates the power to the LED drivers to activate and deactivate the LED drivers. As described in connection with FIG. 1 above, other methods of activating and deactivating the LED drivers can be used.

Centralized Control with Multi-Chip LED Driver

Figure 6:
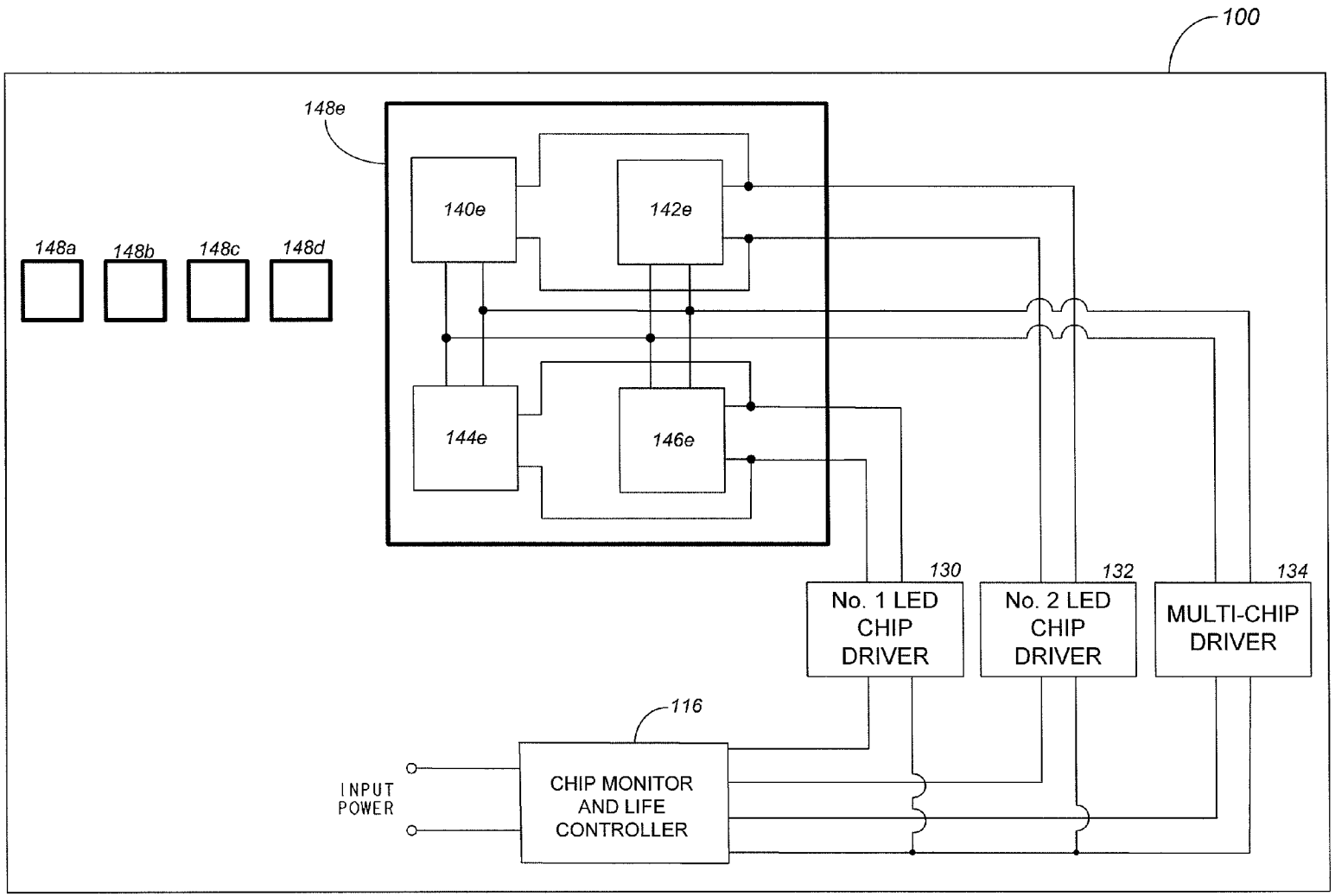
FIG. 6 illustrates a single light fixture with multiple LED drivers, a multi-chip LED driver, multiple multi-chip LED packages. and a central controller according to one embodiment of the invention.

FIG. 6 illustrates an embodiment of the present invention that differs from the embodiment illustrated by FIG. 5 by the addition of a multi-chip LED driver. The single light fixture 100 includes five multi-chip LED packages 148*a*, 148*b*, 148*c*, 148*d*, 148*e* (only 148*e* is shown in detail), two LED drivers 130, 132, a multi-chip LED driver 134 and a central controller 116. The components of the light fixture are connected in a manner similar to that described above in connection with FIG. 5. The multi-chip LED driver 134 is connected to the central controller 116 and to all of the LED chips in all of the multi-chip LED packages.

The operation of the light fixture illustrated by FIG. 6 is similar to that described above in connection with FIG. 5 for the activation and deactivation of the first LED driver and the second LED driver. Once the operating parameter of the second LED driver satisfies the predetermined value, the central controller deactivates the second LED driver which deactivates the second subset of LED chips and activates the multi-chip LED driver which activates all of the LED chips in all of the LED packages. In some embodiments, the central controller monitors the multi-chip LED driver and once the predetermined value is met the central controller deactivates the multi-chip LED driver which deactivates all of the LED chips. In other embodiments, the central controller does not monitor the multi-chip LED driver.

The multi-chip LED driver illustrated by FIG. 6 is connected to all of the chips within all of the multi-chip LED packages. Similar to the multi-lamp LED driver of FIG. 2, the multi-chip LED driver can be connected to less than all of the LED chips in the multi-chip LED packages. For example, the multi-chip LED driver could be connected to less than all of the LED chips within the multi-chip LED packages or could be connected to less than all of the multi-chip LED packages.

FIG. 6 illustrates that the central controller is connected to the power input into the fixture. In this embodiment, the central controller gates the power to the LED drivers and the multi-chip LED driver to activate and deactivate the LED drivers and the multi-chip LED driver. As described in connection with FIG. 1 above, other methods of activating and deactivating the LED drivers and multi-chip LED driver can be used, including wireless communication.

Distributed Control

Figure 7:
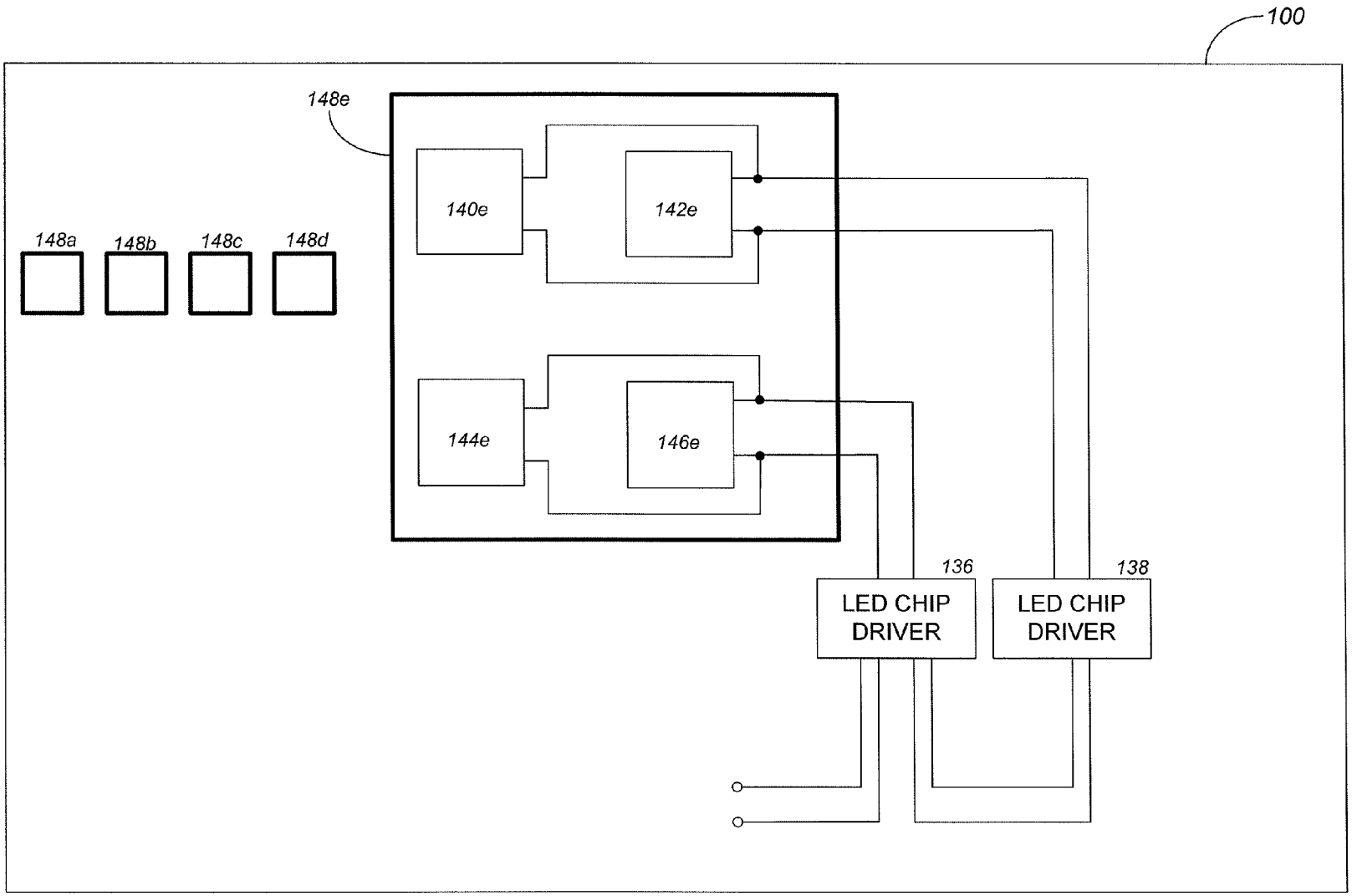
FIG. 7 illustrates a single light fixture with multiple LED drivers and controller and multiple multi-chip LED packages according to one embodiment of the invention.

FIG. 7 illustrates an embodiment of the present invention that differs from the embodiment illustrated by FIG. 5 in that the controller function is distributed among the LED drivers. The single light fixture 100 includes five multi-chip LED packages 148*a*, 148*b*, 148*c*, 148*d*, 148*e* (only 148*e* is shown in detail) and two LED drivers 136, 138. Each LED driver includes a controller and is connected to at least one other LED driver (i.e., 136 and 138 are connected to each other). The controller function can be integrated with the LED driver or can be provided by a separate device that is connected to the LED driver. Each multi-chip package contains four LED chips e.g., 140*e*, 142*e*, 144*e*, 146*e*. The first LED driver 136 is connected to two of the four LED chips, e.g., 144*e*, 146*e*, within each of the multi-chip LED packages and the second LED driver 138 is connected to the remaining two LED chips e.g., 140*e*, 142*e*, within the multi-chip LED packages.

The controller of the first LED driver activates the first LED driver to drive the first subset of LED chips. The controller of the first LED driver monitors one or more operating parameters of the first LED driver until the operating parameters satisfy a predetermined value. Once the monitored operating parameter of the first LED driver satisfies the predetermined value, the controller of the first LED driver deactivates the first LED driver which deactivates the first subset of LED chips and activates the second LED driver so that it drives the second subset of LED chips.

In some embodiments, the controller of the second LED driver monitors the second LED driver. Once the operating parameter satisfies the predetermined criteria, the controller of the second LED driver, deactivates the second LED driver which deactivates the second subset of LED chips. In other embodiments, the second LED driver does not include a controller and the second LED driver and second subset of LED chips are operated until they fail or are replaced.

FIG. 7 illustrates that the power input to the fixture is fed into the first LED controller. In this embodiment, the first LED controller gates the power to the first LED driver to activate and deactivate the first LED driver and gates the power to the second LED controller. As will be apparent to those skilled in the art, other methods of activating and deactivating the LED drivers can be used, including wireless communication.

Distributed Control with Multi-Chip LED Driver

Figure 8:
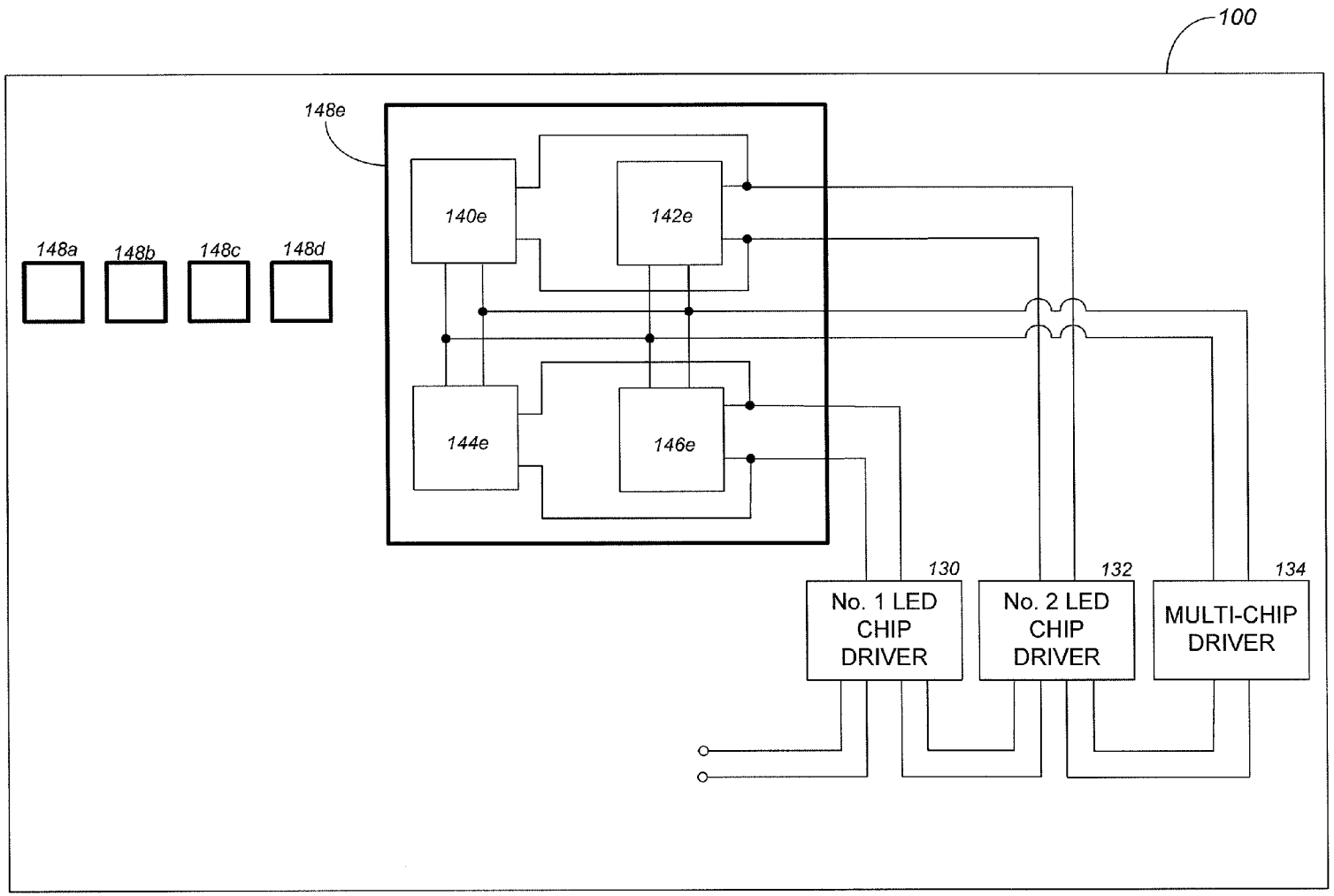
FIG. 8 illustrates a single light fixture with multiple LED drivers and controllers, a multi-chip LED driver and controller, and multiple multi-chip LED packages according to one embodiment of the invention.

FIG. 8 illustrates an embodiment of the present invention that differs from the embodiment illustrated by FIG. 7 by the addition of a multi-chip LED driver. The single light fixture 100 includes five multi-chip LED packages 148*a*, 148*b*, 148*c*, 148*d*, 148*e* (only 148*e* is shown in detail), two LED drivers 136, 138, and a multi-chip LED driver 139. Each LED driver includes a controller. The components of the light fixture are connected in a manner similar to that described above in connection with FIG. 7. The multi-chip LED driver 139 is connected to the second LED driver and to all of the LED chips in all of the multi-chip LED packages.

The operation of the light fixture illustrated by FIG. 8 is similar to that described above in connection with FIG. 7 for the activation and deactivation of the first LED driver and the second LED driver. Once the operating parameter of the second LED driver satisfies the predetermined value, the controller associated with the second LED driver deactivates the second LED driver which deactivates the second subset of LED chips and activates the multi-chip LED driver which activates all of the LED chips in all of the LED packages. In some embodiments, the multi-chip LED driver includes a controller to monitor the multi-chip LED driver. Once the predetermined value is met, the controller deactivates the multi-chip LED driver which deactivates all of the LED chips. In other embodiments, the multi-chip LED driver does not include a controller.

The multi-chip LED driver illustrated by FIG. 8 is connected to all of the chips within all of the multi-chip LED packages. Similar to the multi-chip LED driver of FIG. 6, the multi-chip LED driver can be connected to less than all of the LED chips in the multi-chip LED packages.

FIG. 8 illustrates that the first LED controller is connected to the power input into the fixture. In this embodiment, the first LED controller gates the power to the first LED driver to activate and deactivate the first LED driver and gates the power to the second LED controller. The second LED controller gates the power to the second LED driver to activate and deactivate the second LED driver and gates the power to the multi-lamp LED driver. The multi-lamp LED controller gates the power to the multi-lamp LED driver.

Exemplary Methods of Operation

Figure 9:
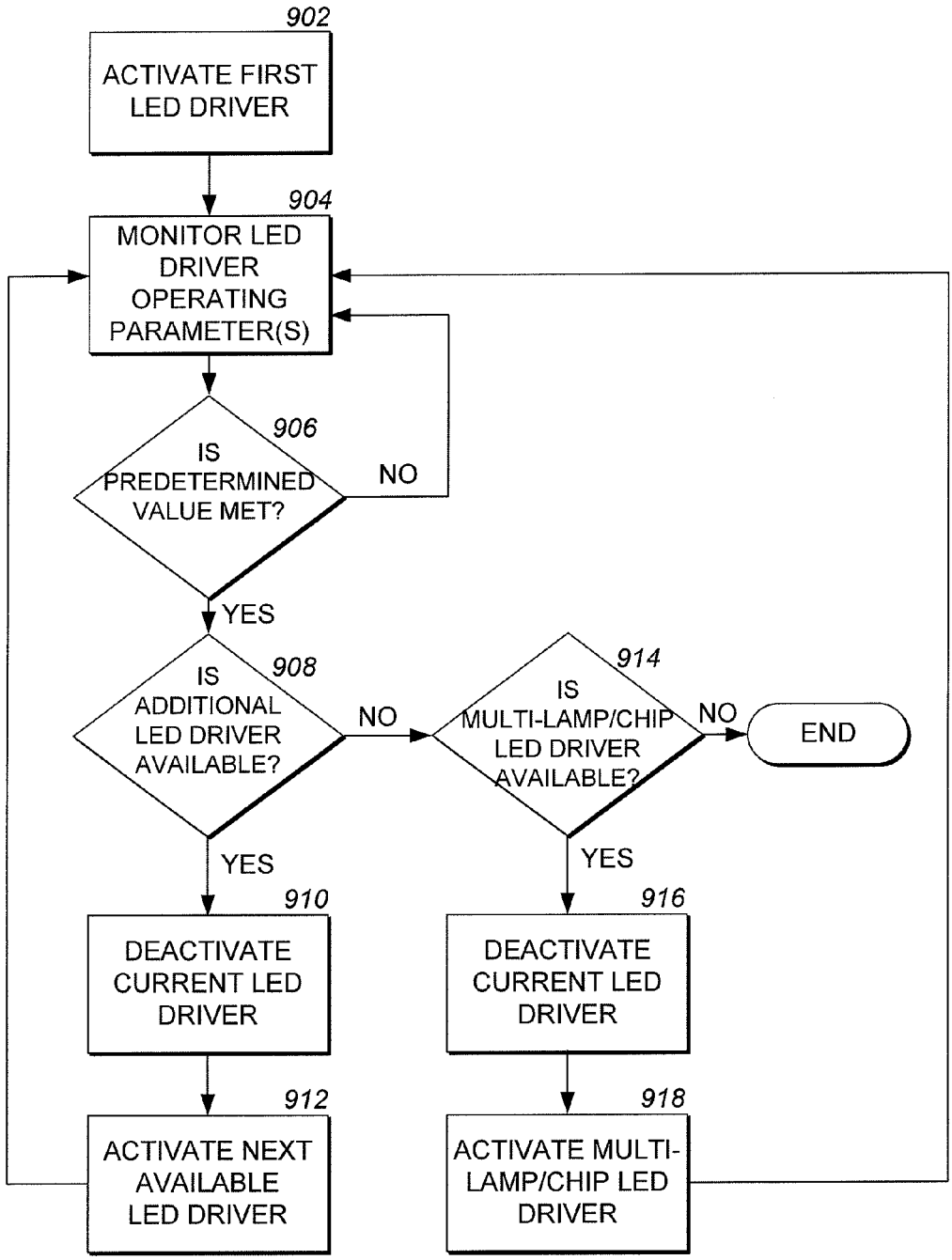
FIG. 9 illustrates an exemplary method of operation of a single light fixture according to one embodiment of the present invention.

FIG. 9 illustrates an exemplary method for the operation of a single light fixture having multiple LED drivers and multiple LED lamps or multi-chip LED packages and optionally a multi-lamp or multi-chip LED driver. In 902, the controller (central or distributed) activates the first LED driver to drive the associated first LED lamp/subset of chips and in 904, the controller monitors the operating parameter of the activated LED driver. In 906 the controller determines if the monitored operating parameter satisfies the predetermined value. If the determination is NO, then the NO branch is followed back to 904 and the controller continues monitoring the current LED driver. If the determination is YES, then the YES branch is followed to 908. In 908, the controller determines if there is another LED driver that has not been activated. If the determination is YES, then the YES branch is followed to 910. Since an additional LED driver is available, the controller deactivates the current LED driver in 910 and in 912 the controller activates the next LED driver. The method then proceeds back to 904.

If the determination at 908 is NO, the NO branch is followed to 914 where the controller determines whether a multi-lamp/multi-chip LED driver is available. If the determination is YES, then the YES branch is followed to 916 and the current LED driver is deactivated. In 918, the multi-lamp/multi-chip LED driver is activated. The method then proceeds back to 904 and the multi-lamp/multi-chip LED driver is monitored.

If the determination at 914 is NO, then the method ends. The method can end by either deactivating the current LED driver so that the connected LED lamp/chip subset is turned off or allowing the current LED driver and/or connected LED lamp/chip subset to operate until the end of their lifetime.

Figure 10:
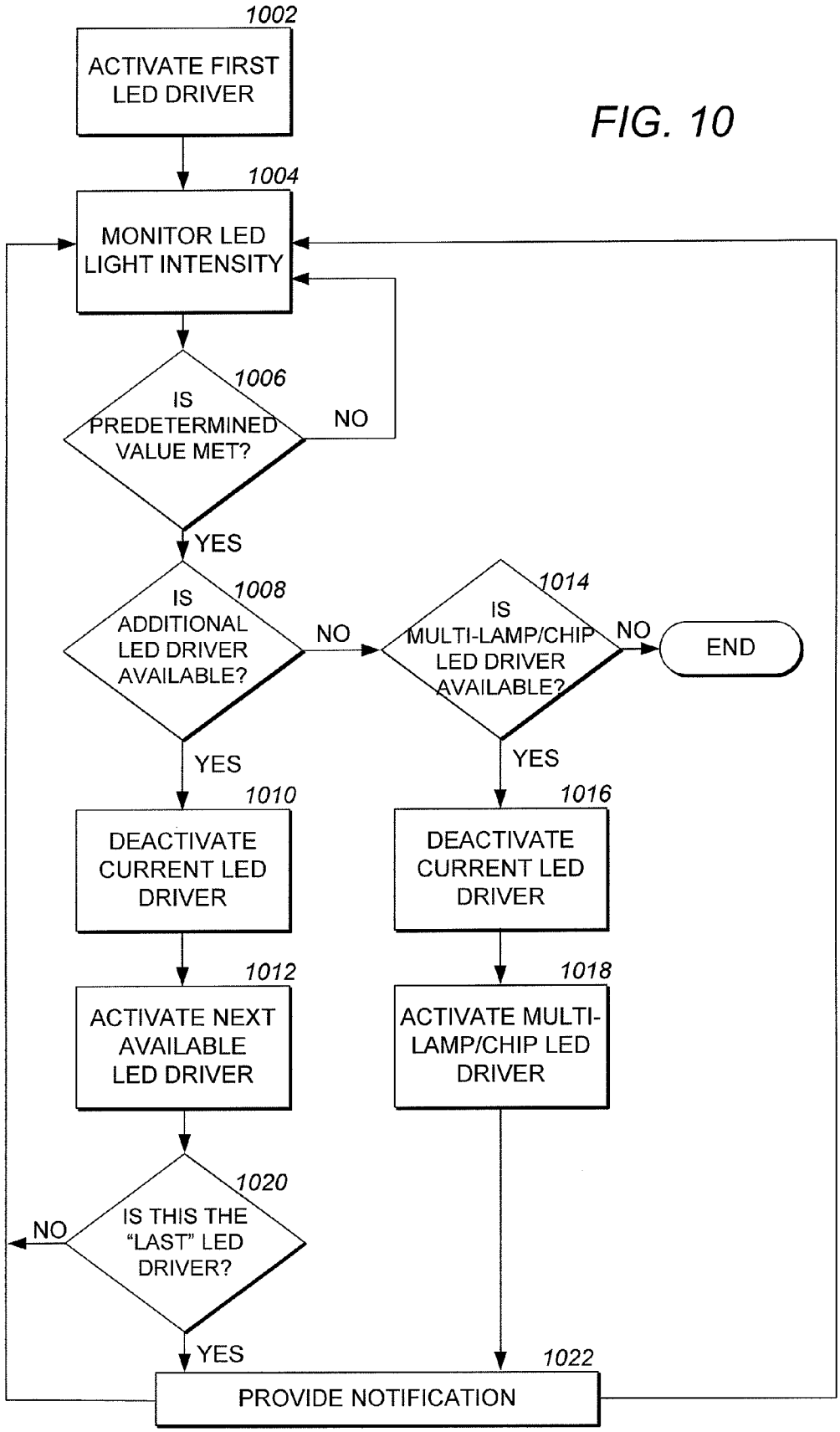
FIG. 10 illustrates an exemplary method of operation of a single light fixture according to another embodiment of the present invention.

In some embodiments of the present invention, the controller(s) monitors light intensity rather than an operating parameter associated with the LED driver. FIG. 10 illustrates an exemplary method for the operation of a single light fixture having multiple LED drivers and multiple LED lamps or multi-chip LED packages and optionally a multi-lamp or multi-chip LED driver. In 1002, the controller (central or distributed) activates the first LED driver to drive the associated first LED lamp/subset of chips and in 1004, the controller monitors the output light intensity of the activated LED lamps/subset of chips. In 1006 the controller determines if the monitored light intensity satisfies a predetermined value. If the determination is NO, then the NO branch is followed back to 1004 and the controller continues monitoring the light intensity. If the determination is YES, then the YES branch is followed to 1008. In 1008, the controller determines if there is another LED driver that has not been activated. If the determination is YES, then the YES branch is followed to 1010. Since an additional LED driver is available, the controller deactivates the current LED driver in 1010 and in 1012 the controller activates the next LED driver. In 1020, the controller determines whether the "last" LED driver has been activated, i.e., whether all of the LED drivers have been activated. If the determination is YES, then a notification signal is generated to provide a warning that maintenance will soon be required at 1022. For example, if there are three LED drivers and no multi-lamp/multi-chip LED driver, once the third LED driver is activated at 1012, the determination at 1020 is YES. If there are three LED drivers and a multi-lamp/multi-chip LED driver, once the third LED driver is activated at 1012, the determination at 1020 is NO since the notification will be provided once the multi-lamp/multi-chip LED driver is activated, as described in the following paragraph. The notification signal may activate an indicator lamp on the luminaire or may initiate a communications message, such as an e-mail message or message to a central facility. Once the notification is sent, or if the determination at 1020 is NO, then the method proceeds back to 1004.

If the determination at 1008 is NO, the NO branch is followed to 1014 where the controller determines whether a multi-lamp/multi-chip LED driver is available. If the determination is YES, then the YES branch is followed to 1016 and the current LED driver is deactivated. In 1018, the multi-lamp/multi-chip LED driver is activated and a notification signal is generated to provide a warning that maintenance will soon be required at 1022. Once the notification is sent, the method proceeds back to 1004 and the output light intensity is monitored.

If the determination at 1014 is NO, then the method ends. The method can end by either deactivating the current LED driver so that the connected LED lamp/chip subset is turned off or allowing the current LED driver and/or connected LED lamp/chip subset to operate until the end of their lifetime.

The methods illustrated by FIGS. 9 and 10 are exemplary and modifications will be apparent to those skilled in the art. For example, the deactivation of the current LED driver can occur prior to determining whether there is an additional LED driver or a multi-lamp/multi-chip LED driver available. For simplicity, FIGS. 9 and 10 illustrate that the same operating parameter and the same predetermined value are used for each LED driver. However, different operating parameters and/or different predetermined values could be used for different drivers. The notification is optional and also can be used in connection with the method illustrated by FIG. 9. If the notification is used, the notification can be of any type including visual, aural, or a data transmission, including a wireless communication.

The foregoing is provided for purposes of illustrating, describing, and explaining embodiments of the present invention and is not intended to be exhaustive or to limit the invention to the precise forms disclosed. Further modifications and adaptation to these embodiments will be apparent to those skilled in the art and may be made without departing from the scope and spirit of the invention. For example, the number of LED lamps/multi-chip LED packages, LED drivers, and multi-lamp/multi-chip LED drivers within the light fixtures illustrated by the figures are exemplary. Other embodiments can include different numbers of LED lamps, multi-chip LED packages, LED drivers and/or multi-chip LED drivers. Similarly, the invention encompasses different numbers of LEDs within an LED lamp and different numbers of LED chips within a multi-chip LED package. The placement of the controllers, including the central controller and the distributed controllers, depends upon the physical design of the fixture and the invention contemplates controllers within or attached to the fixture.

What is claimed is:

1. A method for controlling a plurality of LED drivers within a single light fixture using a central controller, comprising:

activating a first LED driver so that it drives a first subset of LEDs within at least one multi-chip LED package;

monitoring the first LED driver;

once an operating parameter of the first LED driver satisfies a predetermined value, deactivating the first LED driver and the first subset of LEDs; and activating a second LED driver so that it drives a second subset of LEDs within the at least one multi-chip LED package, wherein the first LED driver is distinct from the second LED driver and the first subset of LEDs is distinct from the second subset of LEDs, and wherein the first LED driver, the second LED driver, and the at least one multi-chip LED package are within the single light fixture.

2. The method of claim 1, wherein the operating parameter is operating time and the predetermined value is based on a selection from the group consisting of: expected operating life of the first LED driver, expected operating life of the first LED lamp, and expected lumen depreciation of the first LED lamp.

3. The method of claim 1, wherein the operating parameter corresponds to an output of the first LED driver and the predetermined value is based on a selection from the group consisting of: a value that indicates a failure of the first LED driver and a value that indicates a performance degradation of the first LED driver.

4. The method of claim 1, further comprising:

monitoring the second LED driver;

once a second operating parameter of the second LED driver satisfies a second predetermined value, deactivating the second LED driver and the second subset of LEDs; and activating a multi-chip LED driver that concurrently drives the first subset of LEDs and the second subset of LEDs.

5. The method of claim 4, wherein the first LED driver drives the first subset of LEDs at a first level and the second LED driver drives the second subset of LEDs at a second level and wherein the multi-chip LED driver drives the first subset of LEDs at approximately the first level and drives the second subset of LEDs at approximately the second level.

6. The method of claim 4, wherein the first LED driver drives the first subset of LEDs at a first level and the second LED driver drives the second subset of LEDs at a second level and wherein the multi-chip LED driver drives the first subset of LEDs at a level that is distinct from the first level and drives the second subset of LEDs at a level that is distinct from the second level.

7. A single light fixture, comprising:

a plurality of LED drivers;

a plurality of subsets of LEDs, wherein each subset of LEDs includes a plurality of LEDs within at least one multi-chip LED package and each subset of LEDs is connected to a distinct LED driver; and a central controller, connected to each of the LED drivers, wherein the controller is operable to:

activate a first one of the LED drivers so that a first subset of LEDs associated with the first LED driver is activated;

monitor the first LED driver to determine when an operating parameter of the first LED driver satisfies a predetermined value; and once the first LED driver satisfies the predetermined value, deactivate the first LED driver and activate a second one of the LED drivers so that the first subset of LEDs is deactivated and a second subset of LEDs associated with the second LED driver is activated.

8. The light fixture of claim 7, further comprising:

a multi-chip LED driver, wherein the multi-chip LED driver is connected to each of the subsets of LEDs and is connected to the central controller;

wherein for each of the LED drivers, other than the first LED driver, the central controller is further operable to:

monitor the LED driver to determine when an operating parameter of the LED driver satisfies the predetermined value;

once the LED driver satisfies the predetermined value, deactivate the LED driver;

if at least one of the LED drivers has not been activated, then activate one of the LED drivers that has not been activated; and if all of the LED drivers have been activated, then activate the multi-chip LED driver so that all of the subsets of LEDs are activated concurrently.

9. The light fixture of claim 7, further comprising:

a multi-chip LED driver, wherein the multi-chip LED driver is connected to at least the first subset of LEDs and the second subset of LEDs and is connected to the central controller; and wherein the central controller is further operable to:

monitor the second LED driver to determine when a second operating parameter of the second LED driver satisfies a second predetermined value; and once the second LED driver meets the second predetermined value, deactivate the second LED driver and activate the multi-chip LED driver so that the first and the second subsets of LEDs are activated concurrently.

10. The light fixture of claim 9, wherein the first LED driver drives the first subset of LEDs at a first level and the second LED driver drives the second subset of LEDs at a second level and wherein the multi-chip LED driver drives the first subset of LEDs at approximately the first level and drives the second subset of LEDs at approximately the second level.

11. The light fixture of claim 8, wherein the first LED driver drives the first subset of LEDs at a first level and the second LED driver drives the second subset of LEDs at a second level, and wherein the multi-chip LED driver drives the first subset of LEDs at a level distinct from the first level and drives the second subset of LEDs at a level distinct from the second level.

12. The light fixture of claim 7, wherein the operating parameter is operating time and the central controller monitors the operating time of the LED drivers.

13. The light fixture of claim 7, wherein the operating parameter corresponds to an output of the first LED driver and the central controller monitors the output of the first LED driver.

14. A single light fixture, comprising:

a plurality of LED drivers;

a plurality of subsets of LEDs, wherein each subset of LEDs includes a plurality of LEDs within at least one multi-chip LED package and each subset of LEDs is connected to a distinct LED driver;

a multi-chip LED driver, wherein the multi-chip LED driver is connected to at least two of the subsets of LEDs; and a central controller, connected to each of the LED drivers and the multi-chip LED driver, wherein the controller is operable to:

activate a first one of the LED drivers so that a first subset of LEDs associated with the first LED driver is activated;

monitor the first LED driver to determine when an operating parameter of the first LED driver satisfies a predetermined value;

once the first LED driver satisfies the predetermined value, deactivate the first LED driver and activate a second one of the LED drivers so that the first subset of LEDs is deactivated and a second subset of LEDs associated with the second LED driver is activated;

monitor the second LED driver to determine when a second operating parameter of the second LED driver satisfies a second predetermined value;

once the second LED driver satisfies the second predetermined value, deactivate the second LED driver and activate the multi-chip LED driver so that the multi-chip LED driver concurrently activates the first subset of LEDs and the second subset of LEDs.

15. The light fixture of claim 14, wherein the operating parameter is operating time and the predetermined value is based on a selection from the group consisting of: expected operating life of the LED drivers, expected operating life of the first LED lamp, and expected lumen depreciation of the first LED lamp.

16. The light fixture of claim 14, wherein the operating parameter corresponds to an output of the first LED driver and the predetermined value is based on a selection from the group consisting of: a value that indicates a failure of the first LED driver and a value that indicates a degradation of the first LED driver.

17. The light fixture of claim 14, wherein the first LED driver drives the first subset of LEDs at a first level and the second LED driver drives the second subset of LEDs at a second level and wherein the multi-chip LED driver drives the first subset of LEDs at approximately the first level and drives the second subset of LEDs at approximately the second level.

18. The light fixture of claim 14, wherein the first LED driver drives the first subset of LEDs at a first level and the second LED driver drives the second subset of LEDs at a second level and wherein the multi-chip LED driver drives the first subset of LEDs at a level that is distinct from the first level and drives the second subset of LEDs at a level that is distinct from the second level.

19. A method for controlling a plurality of LED drivers within a single light fixture using a central controller, comprising:

activating a first LED driver so that it drives a first subset of LEDs within at least one multi-chip LED package;

monitoring light intensity output by the first subset of LEDs;

once the light intensity output by the first subset of LEDs satisfies a predetermined value, deactivating the first LED driver and the first subset of LEDs; and activating a second LED driver so that it drives a second subset of LEDs within the at least one multi-chip LED package, wherein the first LED driver is distinct from the second LED driver and the first subset of LEDs is distinct from the second subset of LEDs, and wherein the first LED driver, the second LED driver, and the at least one multi-chip LED package are within the single light fixture.

20. The method of claim 19, further comprising:

monitoring light intensity output by the second subset of LEDs;

once the light intensity output by the second subset of LEDs satisfies a second predetermined value, deactivating the second LED driver and the second subset of LEDs; and activating a multi-chip LED driver that concurrently drives the first subset of LEDs and the second subset of LEDs.

21. The method of claim 20, wherein the first LED driver drives the first subset of LEDs at a first level and the second LED driver drives the second subset of LEDs at a second level and wherein the multi-chip LED driver drives the first subset of LEDs at approximately the first level and drives the second subset of LEDs at approximately the second level.

22. The method of claim 20, wherein the first LED driver drives the first subset of LEDs at a first level and the second LED driver drives the second subset of LEDs at a second level and wherein the multi-chip LED driver drives the first subset of LEDs at a level that is distinct from the first level and drives the second subset of LEDs at a level that is distinct from the second level.

* * * * *